US007113161B2

(12) United States Patent
Nirasawa et al.

(10) Patent No.: US 7,113,161 B2
(45) Date of Patent: Sep. 26, 2006

(54) HORIZONTAL SHIFT CLOCK PULSE SELECTING CIRCUIT FOR DRIVING A COLOR LCD PANEL

(75) Inventors: Yoshio Nirasawa, Mukou (JP); Yuji Amano, Takatsuki (JP); Norihide Kinugasa, Joyo (JP)

(73) Assignee: Matsushita Electric Industiral Co., Ltd., Osaka (JP)

( * ) Notice: Subject to any disclaimer, the term of this patent is extended or adjusted under 35 U.S.C. 154(b) by 527 days.

(21) Appl. No.: 10/704,153

(22) Filed: Nov. 10, 2003

(65) Prior Publication Data

US 2004/0135759 A1 Jul. 15, 2004

(30) Foreign Application Priority Data

Nov. 25, 2002 (JP) ..... 2002-340664

(51) Int. Cl.
*G09G 3/36* (2006.01)

(52) U.S. Cl. ..... 345/99

(58) Field of Classification Search ..... 345/98–100
See application file for complete search history.

(56) References Cited

U.S. PATENT DOCUMENTS 4,364,080 A * 12/1982 Vidovic ..... 348/185
5,963,604 A * 10/1999 Greiss ..... 375/355
6,603,450 B1 * 8/2003 Yamazaki et al. ..... 345/75.2
2002/0176009 A1 * 11/2002 Johnson et al. ..... 348/229

FOREIGN PATENT DOCUMENTS

JP 05037909 2/1993

* cited by examiner

*Primary Examiner*—Sumati Lefkowitz
*Assistant Examiner*—Rodney Amadiz
(74) *Attorney, Agent, or Firm*—Stevens, Davis, Miller & Mosher, LLP

(57) ABSTRACT

An influence of a switching noise caused by a horizontal shift clock to an oscillation frequency of a voltage controlled oscillator should be eliminated, to prevent an image shift in a PAL skip period. For this purpose, an odd number line horizontal shift clock from an odd number line horizontal shift clock generator and an even number line horizontal shift clock from an even number line horizontal shift clock generator are switched by a horizontal shift clock switching circuit, to be input to a color LCD panel. The horizontal shift clock switching circuit selects and outputs either the odd number line horizontal shift clock or the even number line horizontal shift clock according to a line identifying signal, in a normal period. By contrast, in a PAL skip period a selecting state of the shift clock is inverted immediately upon start of a PAL skip period, from a selecting state right before the start of the skip period, and the selecting state is again inverted in half a cycle of a horizontal scanning period.

4 Claims, 7 Drawing Sheets

HORIZONTAL SHIFT CLOCK PULSE SELECTING CIRCUIT FOR DRIVING A COLOR LCD PANEL

BACKGROUND OF THE INVENTION

1. Field of the Invention

The present invention relates to a horizontal shift clock pulse selecting circuit for driving a color LCD panel used for driving an image signal of a color LCD panel, more specifically to a horizontal shift clock pulse selecting circuit for driving a color LCD panel, appropriate for driving with a skip period required in a PAL system.

2. Prior Art

With reference to pixel alignment in a color LCD panel, a color LCD panel of a delta alignment in which a pixel array is shifted by 0.5 pixel with respect to the adjacent array as shown in FIG. 2, and a color LCD panel of a stripe alignment in which pixels are vertically aligned in a straight line are known in the art. The present invention is appropriate for driving a color LCD panel of a delta alignment by a PAL system.

For driving a color LCD panel of a delta alignment, it is necessary to set a horizontal shift clock to provide a pulse for selecting a pixel, according to a pixel array. FIG. 3 shows odd number lines of horizontal shift clock CPHO1, CPHO2, CPHO3, and even number lines of horizontal shift clock CPHE1, CPHE2, CPHE3.

A rising of the odd number line horizontal shift clock CPHO1 and a rising of the odd number line horizontal shift clock CPHO2 are shifted by 1 pixel. A rising of the odd number line horizontal shift clock CPHO2 and a rising of the odd number line horizontal shift clock CPHO3 are shifted by 1 pixel. A rising of the odd number line horizontal shift clock CPHO3 and the rising of the next odd number line horizontal shift clock CPHO1 are shifted by 1 pixel.

Likewise, a rising of the even number line horizontal shift clock CPHE1 and a rising of the even number line horizontal shift clock CPHE2 are shifted by 1 pixel. A rising of the even number line horizontal shift clock CPHE2 and a rising of the even number line horizontal shift clock CPHE3 are shifted by 1 pixel. A rising of the even number line horizontal shift clock CPHE3 and the rising of the next even number line horizontal shift clock CPHE1 are shifted by 1 pixel.

Further, a rising of the odd number line horizontal shift clock CPHO1 and a rising of the even number line horizontal shift clock CPHE1 are shifted by 0.5 pixel.

Meanwhile, a display period of 1 field in a color LCD panel is different between an NTSC system and a PAL system. The display period of an NTSC system is 225 H, while that of a PAL system is 257 H. Therefore, for securing compatibility of a color LCD panel with the both systems, the display period of the PAL system is adjusted to that of the NTSC system by skipping horizontal scanning periods at a ratio of m (an arbitrary integer) horizontal scanning periods per n (an arbitrary integer, but m<n) horizontal scanning periods.

FIG. 6 shows a block diagram of a typical conventional horizontal shift clock pulse selecting circuit for driving a color LCD panel, and FIG. 7 shows timing charts of each section of the circuit. Operation of this circuit is described below referring to these drawings.

In FIG. 6, the reference numeral 1 shows a voltage controlled oscillator (VCO) in a phase lock loop (PLL).

Numeral 2 shows an odd number line horizontal shift clock generating circuit (ODD block). The odd number line horizontal shift clock generating circuit 2 generates the odd number line horizontal shift clocks CPHO1, CPHO2, CPHO3 shown in FIG. 3, based on an output signal from the voltage controlled oscillator (VCO).

Numeral 3 shows an even number line horizontal shift clock generator (EVEN block). The even number line horizontal shift clock generating circuit 3 generates the even number line horizontal shift clocks CPHE1, CPHE2, CPHE3 shown in FIG. 3, based on an output signal from the voltage controlled oscillator (VCO).

Numeral 4 shows a horizontal shift clock switching circuit consisting of 9 NAND circuits. The horizontal shift clock switching circuit 4 outputs horizontal shift clock outputs CPH1, CPH2, CPH3.

Numeral 5 shows an inverter.

Numeral 8 shows an ODD/EVEN selecting circuit constituted of the inverter 5. The ODD/EVEN selecting circuit 8 receives an input of a line identifying signal VCP33 by which to identify whether an odd number line or an even number line, and outputs NVCP33, which is an inverted signal of the line identifying signal VCP33.

Numeral 11 shows a color LCD panel (constituting a liquid crystal display unit) of a delta alignment.

Description on operation of the horizontal shift clock pulse selecting circuit for driving a color LCD panel is given hereunder.

The odd number line horizontal shift clocks CPHO1, CPHO2, CPHO3 generated by the odd number line horizontal shift clock generator 2 and the even number line horizontal shift clocks CPHE1, CPHE2, CPHE3 generated by the even number line horizontal shift clock generator 3 are alternately selected by the horizontal shift clock switching circuit 4 according to the line identifying signal VCP33 and the signal NVCP33 shown in FIG. 7, which is an inverted signal of VCP33, so that the horizontal shift clock switching circuit 4 outputs the horizontal shift clock outputs CPH1, CPH2, CPH3.

Accordingly, in this horizontal shift clock pulse selecting circuit for driving a color LCD panel, the odd number line horizontal shift clocks CPHO1, CPHO2, CPHO3 and the even number line horizontal shift clocks CPHE1, CPHE2, CPHE3 are alternately switched when inputting the horizontal shift clock outputs CPH1, CPH2, CPH3 to the color LCD panel 11.

As shown in FIG. 7, in a usual case of the PAL system the odd number line horizontal shift clocks CPHO1, CPHO2, CPHO3 are selected in the odd number line, and the even number line horizontal shift clocks CPHE1, CPHE2, CPHE3 are selected in the even number line, as the horizontal shift clock outputs CPH1, CPH2, CPH3. In other words, the odd number line horizontal shift clocks CPHO1, CPHO2, CPHO3 and the even number line horizontal shift clocks CPHE1, CPHE2, CPHE3 are alternately selected.

However, in a skip period, the line identifying signal VCP33 maintains the same state as the preceding line, as shown in FIG. 7. Therefore, the same odd number line or even number line horizontal shift clocks are selected as the horizontal shift clock outputs CPH1, CPH2, CPH3, to be input to the color LCD panel 11. Also, in a skip period, since the line does not advance though the horizontal shift clock outputs CPH1, CPH2, CPH3 are input to the color LCD panel 11, the image to be displayed is not affected. Consequently, the same display as the NTSC system becomes possible by the color LCS panel of the PAL system regardless of a phase of the horizontal shift clock in a skip period.

Meanwhile referring to FIG. 7, the reference code To shows an initialization time of the odd number line horizontal shift clock, and Te shows an initialization time of the even number line horizontal shift clock.

Also, for displaying through a color LCD panel of the NTSC system an image signal of the PAL system skipping a horizontal scanning line, a technique has been proposed for alleviating image quality degradation that consists in differentiating the horizontal scanning line to be skipped in the odd number field from that in the even number field, as well as differentiating by frame (For example, JP-A No. H5-37909, paragraphs 0013 to 0015, FIG. 1).

For driving a color LCD panel of a delta alignment, basically the odd number line horizontal shift clocks CPHO1, CPHO2, CPHO3 and the even number line horizontal shift clocks CPHE1, CPHE2, CPHE3 are alternately selected by the line as the horizontal shift clock outputs CPH1, CPH2, CPH3, and these outputs are input to the color LCD panel of a delta alignment 11.

At this stage, the horizontal shift clock outputs CPH1, CPH2, CPH3 affects an oscillation frequency of the voltage controlled oscillator 1, in a form of a digital switching noise. However, since the horizontal shift clock outputs CPH1, CPH2, CPH3 are switched at every line, the digital switching noise is leveled off and therefore influence thereof to an oscillation frequency of the voltage controlled oscillator 1 is minimal.

However, the horizontal shift clock pulse selecting circuit for driving a color LCD panel of the PAL system according to the conventional art has the following drawback because of skipping the scanning line. In a skip period in the PAL system the line identifying signal VCP33 is maintaining the same state as the preceding line and the horizontal shift clock outputs CPH1, CPH2, CPH3 are not switched. Accordingly, during m horizontal scanning periods out of n horizontal scanning periods, a horizontal shift clock of the same timing as that of the preceding line is output.

Specifically, in a skip period the switching of the horizontal shift clock is not executed alternately, therefore the horizontal shift clock outputs CPH1, CPH2, CPH3 are not leveled off. This means that the digital switching noise is not leveled off either. As a result, an oscillation frequency of the voltage controlled oscillator 1 in the phase lock loop is affected. For such reason a timing of horizontal shift clock outputs CPH1, CPH2, CPH3 are shifted from a desired timing. Consequently, when an image is displayed in the color LCD panel of a delta alignment, the image is shifted in a line next to the skipped line, therefore though a signal to display, for example, a straight line is input to the color LCD panel, the line is not displayed in a straight form.

SUMMARY OF THE INVENTION

It is an object of the present invention to provide a horizontal shift clock pulse selecting circuit for driving a color LCD panel that can correctly display a desired image without causing an image shift in a skip period in the PAL system.

The present invention provides a horizontal shift clock pulse selecting circuit for driving a color LCD panel, comprising a voltage controlled oscillator; an odd number line horizontal shift clock generator for generating an odd number line horizontal shift clock to select a pixel in an odd number line of the color LCD panel based on an output signal of the voltage controlled oscillator; an even number line horizontal shift clock generator for generating an even number line horizontal shift clock to select a pixel in an even number line of the color LCD panel based on an output signal of the voltage controlled oscillator; a horizontal shift clock switching device for selectively outputting the odd number line horizontal shift clock and the even number line horizontal shift clock to the color LCD panel; and a shift clock switch controller for providing a shift clock switching signal to the horizontal shift clock switching device; wherein the shift clock switch controller receives controlling inputs including a PAL skip signal for skipping a horizontal scanning period at a ratio of m (an arbitrary integer) horizontal scanning periods per n (an arbitrary integer, m<n) horizontal scanning periods, an H/2N pulse to be inverted in a cycle of one 2Nth (N is a positive integer) of a horizontal scanning period H (H/2N), and a line selecting pulse for selecting either an odd number line or an even number line, for causing the horizontal shift clock switching device to select either of an odd number line shift clock or an even number line shift clock according to the line selecting pulse in a normal period where the PAL skip signal is not at an effective level, and for inverting a selecting state of the horizontal shift clock by the horizontal shift clock switching device in a cycle of one 2Nth of a horizontal scanning period H (H/2N) in response to the H/2N pulse in a PAL skip period where the PAL skip signal is at an effective level.

It is preferable that the shift clock switch controller inverts immediately upon start of a PAL skip period the selecting state of the horizontal shift clock by the horizontal shift clock switching device from a selecting state right before the start of the skip period. Also, as a color LCD panel referred to herein, for example a color LCD panel provided with delta-aligned pixels of the three primary colors of RGB may be used.

By the configuration according to the present invention, it becomes possible to switch the horizontal shift clock output more than once to an odd number line horizontal shift clock and an even number line horizontal shift clock even in a PAL skip period. As a result, the digital switching noise caused by the horizontal shift clock output from the horizontal shift clock switching device can be leveled off, and an influence to an oscillation frequency of the voltage controlled oscillator can be minimized. Accordingly, an outputting timing of the horizontal shift clock is not shifted from a desired timing. Consequently an image can be prevented from shifting at the next line from the skipped line when displayed through a color LCD panel.

Further, by switching the horizontal shift clock output from the horizontal shift clock switching device in a cycle of one 2Nth (N is a positive integer) of a horizontal scanning period in a PAL skip period, the digital switching noise generated by the horizontal shift clock output according to the conventional art of switching the horizontal shift switch at every line can be leveled off also during the PAL skip period. As a result, an influence to an oscillation frequency of the voltage controlled oscillator in the phase lock loop can be reduced or avoided. Consequently, the horizontal shift clock output in the PAL skip period can be output at a correct timing, and a desired image can be displayed without an image shift even by the PAL system, for example through a color LCD panel of a delta alignment.

DESCRIPTION OF THE PREFERRED EMBODIMENTS

An embodiment of the present invention will be described hereunder referring to the accompanying drawings.

Figure 1:
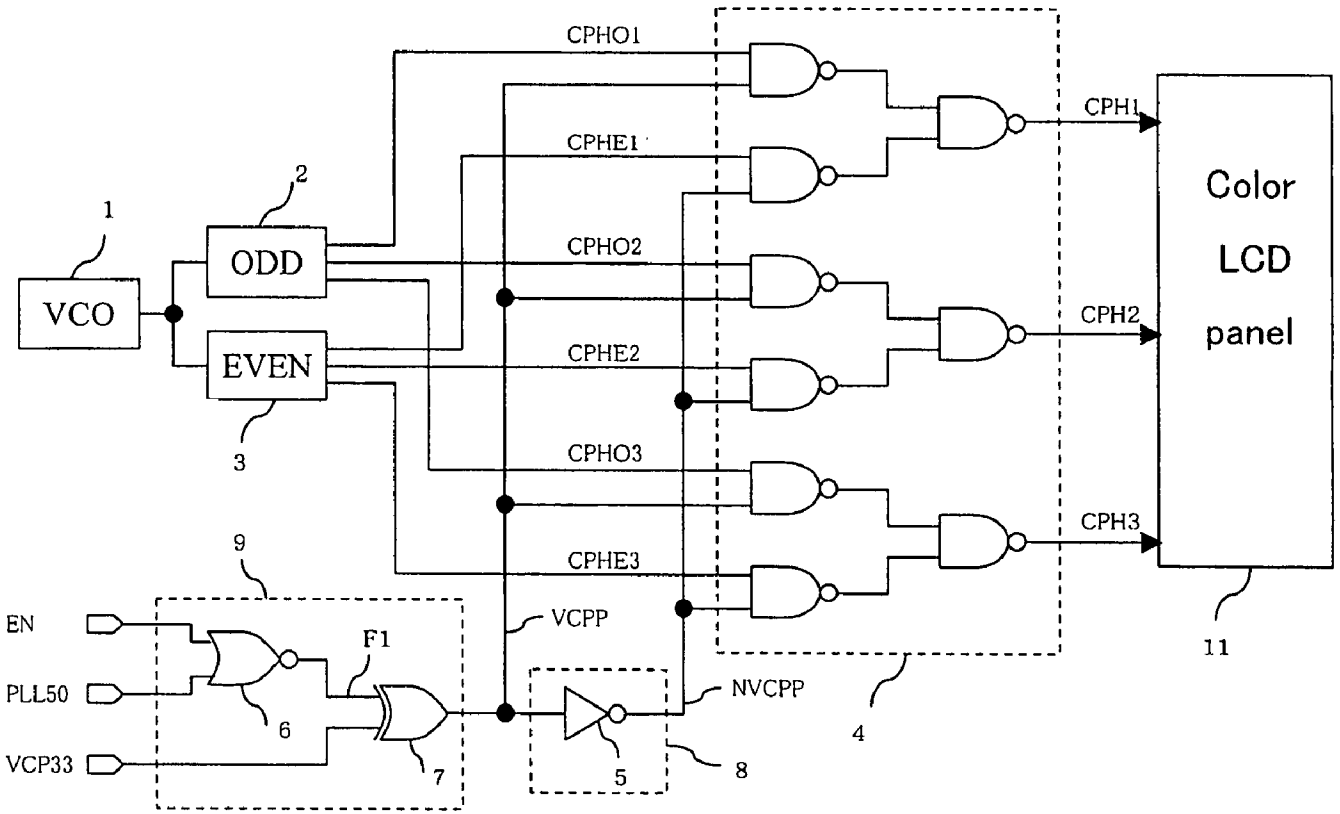
FIG. 1 is a block diagram showing a configuration of a horizontal shift clock pulse selecting circuit for driving a color LCD panel according to an embodiment of the present invention.
Figure 2:
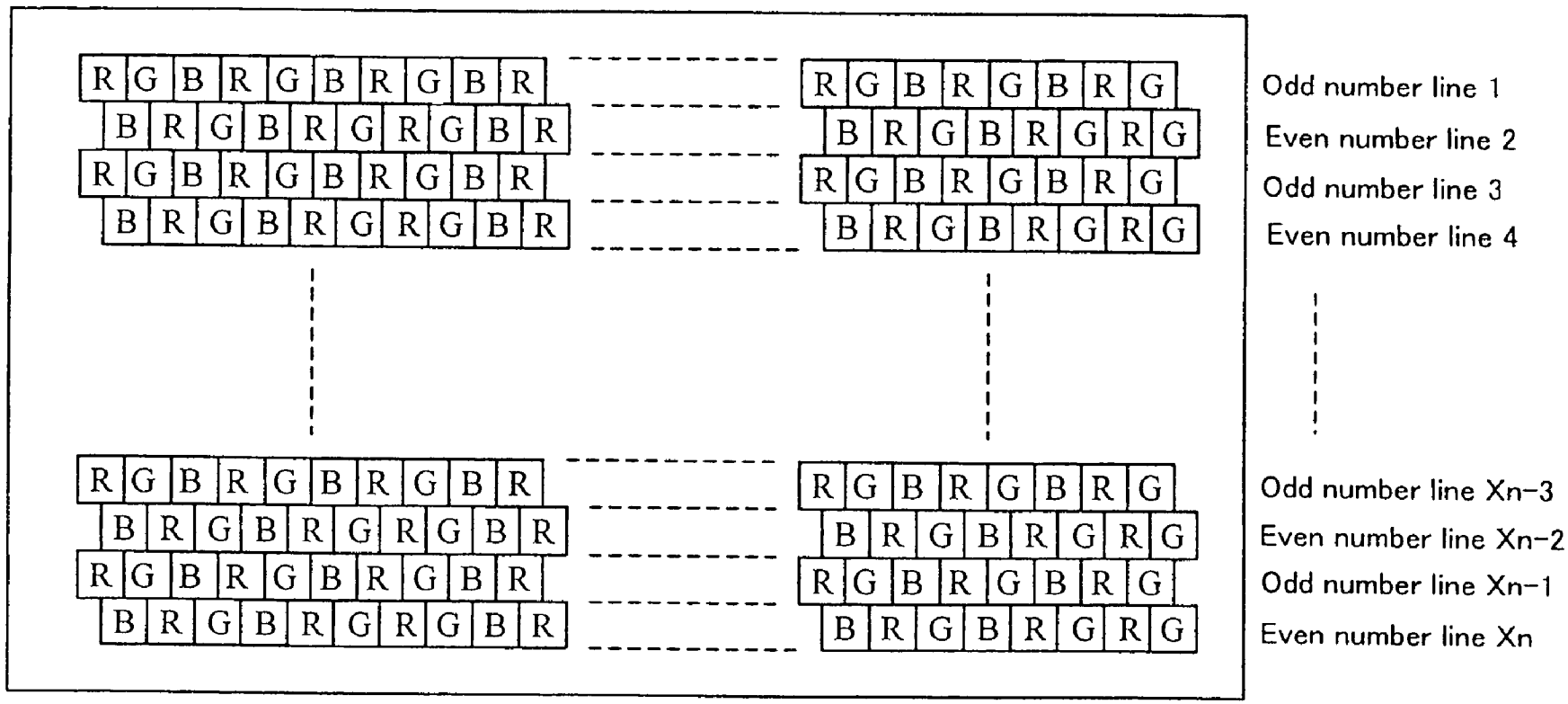
FIG. 2 is a conceptual drawing showing pixel arrays in a color LCD panel of a delta alignment that can be driven by the horizontal shift clock pulse selecting circuit for driving a color LCD panel shown in FIG. 1.

FIG. 1 is a block diagram showing a configuration of a horizontal shift clock pulse selecting circuit for driving a color LCD panel according to the embodiment of the present invention. Also, FIGS. 4 and 5 include time charts of various sections showing a case where a PAL skip is performed at a ratio of one horizontal scanning period every 8th horizontal scanning period according to the embodiment of the present invention.

Figure 6:
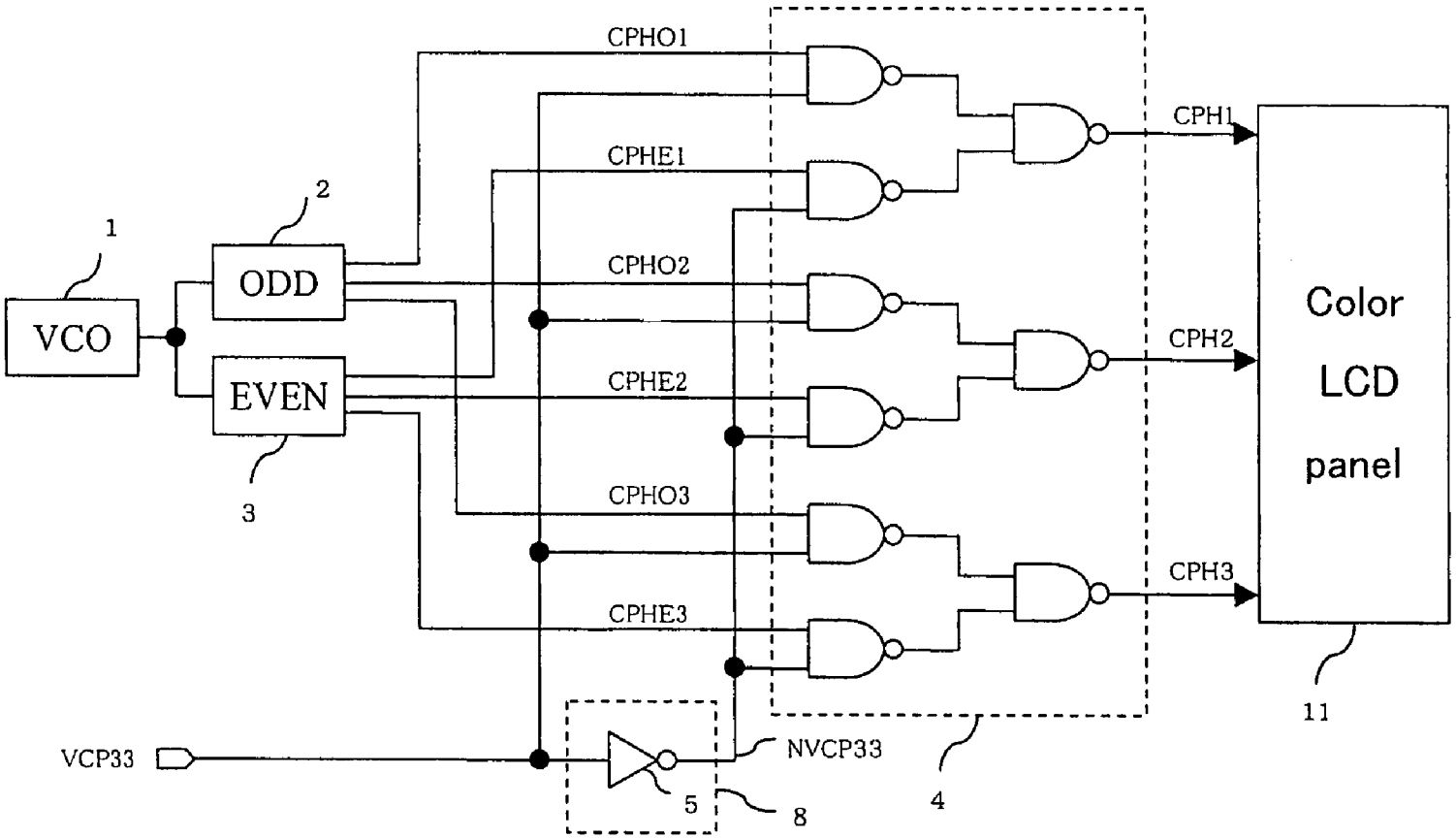
FIG. 6 shows a block diagram of a horizontal shift clock pulse selecting circuit for driving a color LCD panel according to a typical conventional art.
Figure 7:
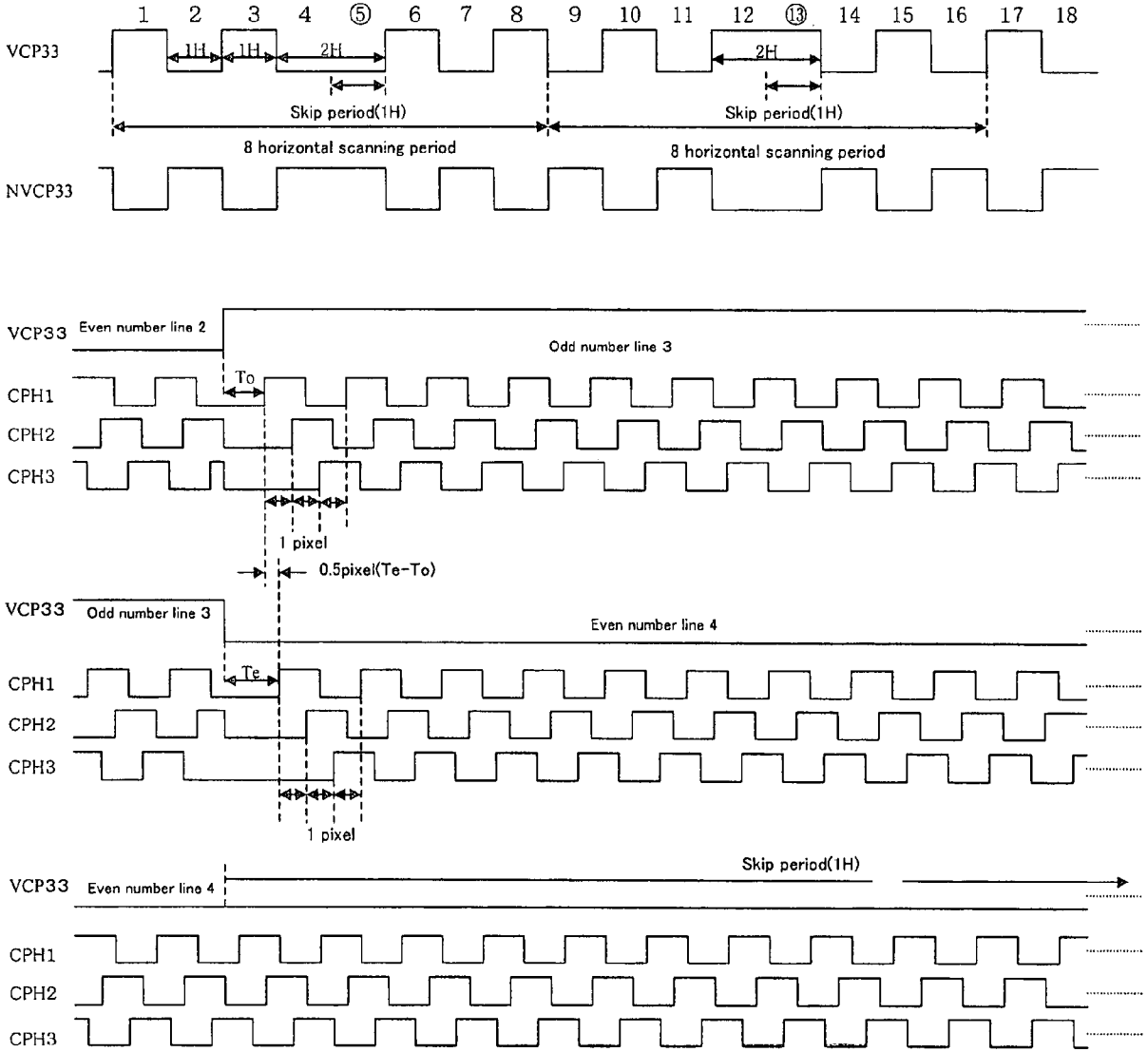
FIG. 7 shows time charts for explaining operation of the horizontal shift clock pulse selecting circuit for driving a color LCD panel shown in FIG. 6 in a PAL skip period.

As shown in FIG. 1, this horizontal shift clock pulse selecting circuit for driving a color LCD panel is different from that of the conventional art shown in FIG. 6 in that a skipped line half H inversion adding circuit 9 has been added.

The skipped line half H inversion adding circuit 9 and the ODD/EVEN selecting circuit 8 correspond to the shift clock switch controller which provides a shift clock switching signal to the horizontal shift clock switching device. Also, the horizontal shift clock switching circuit 4 corresponds to the horizontal shift clock switching device.

According to the conventional art as shown in FIG. 6, the shift clock is switched between the odd number line and the even number line simply by the line identifying signal VCP33. By contrast, according to this embodiment a PAL skip signal EN for skipping a horizontal scanning period every 8th horizontal scanning period, a pulse that operates at half a cycle of one horizontal scanning period (H/2), i.e. a half H clock signal PLL50, and a line selecting pulse for selecting either an odd number line or an even number line, i.e. the line identifying signal VCP33 are used as the controlling inputs, for switching the horizontal shift clock.

Specifically, the skipped line half H inversion adding circuit 9 causes the horizontal shift clock switching circuit 4 to select the odd number line horizontal shift clocks CPHO1, CPHO2, CPHO3 in the odd number line and the even number line horizontal shift clocks CPHE1, CPHE2, CPHE3 in the even number line according to the line identifying signal VCP33 in a normal period.

And in a PAL skip period, the skipped line half H inversion adding circuit 9 inverts immediately upon start of the PAL skip period the selecting state of the horizontal shift clock by the horizontal shift clock switching circuit 4 from a selecting state of a normal period right before the start of the skip period, based on the PAL skip signal EN and the half H clock signal PLL50. Accordingly, in this example the selecting state of the horizontal shift clock is switched once during a skip period.

Now, more detailed description on such horizontal shift clock pulse selecting circuit for driving a color LCD panel will be given hereunder. A clock output from the voltage controlled oscillator 1 is input to the odd number line horizontal shift clock generator 2 and to the even number line horizontal shift clock generator 3. Then the odd number line horizontal shift clocks CPHO1, CPHO2, CPHO3 shown in FIG. 3 are output from the odd number line horizontal shift clock generator 2, and the even number line horizontal shift clocks CPHE1, CPHE2, CPHE3 shown in FIG. 3 are output from the even number line horizontal shift clock generator 3.

Figure 3:
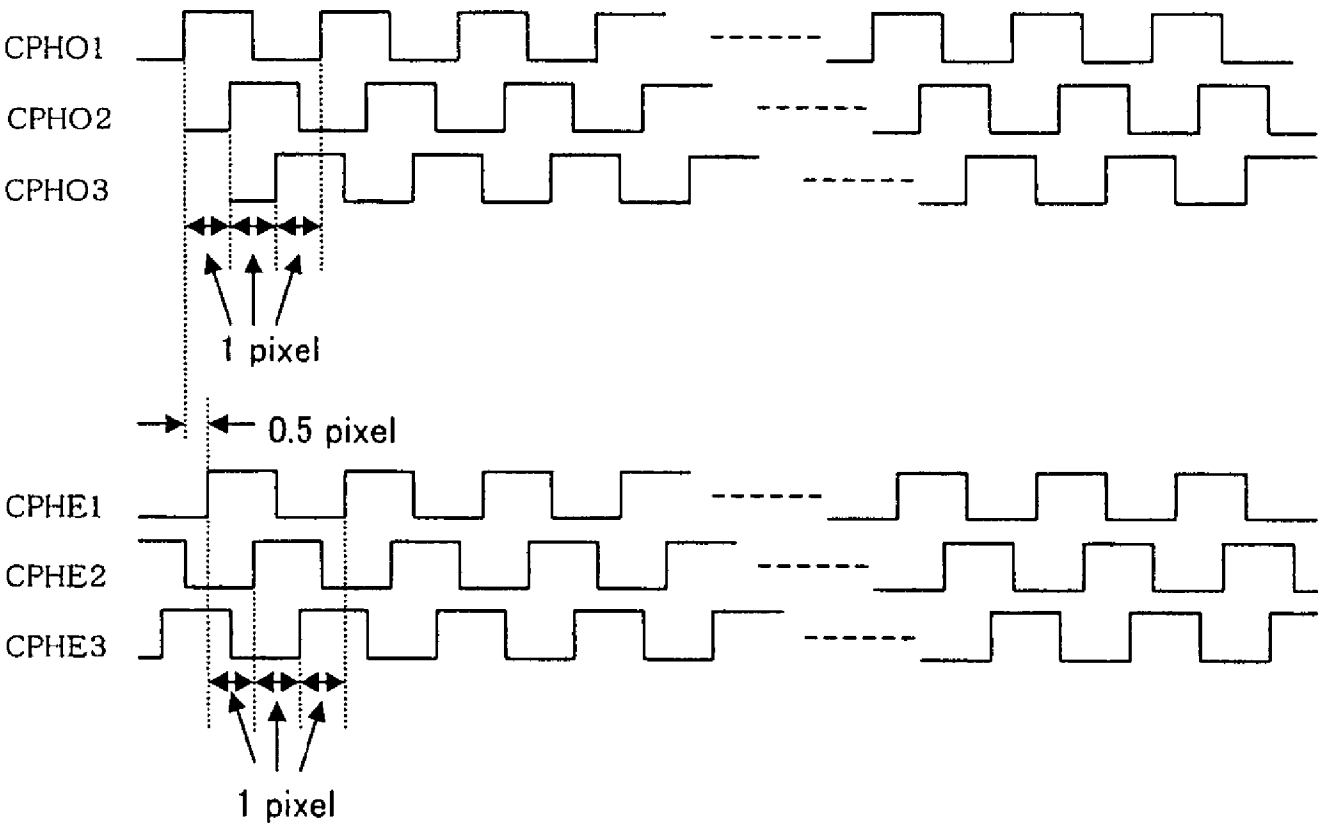
FIG. 3 shows time charts respectively showing odd number line horizontal shift clocks and even number line horizontal shift clocks in the horizontal shift clock pulse selecting circuit for driving a color LCD panel shown in FIG. 1.

As shown in FIG. 3, a period from the rising edge of the odd number line horizontal shift clock CPHO1 to the rising edge of the odd number line horizontal shift clock CPHO2, a period from the rising edge of the odd number line horizontal shift clock CPHO2 to the rising edge of the odd number line horizontal shift clock CPHO3, and a period from the rising edge of the odd number line horizontal shift clock CPHO3 to the rising edge of the next odd number line horizontal shift clock CPHO1, are a period corresponding to 1 pixel respectively.

Likewise, a period from the rising edge of the even number line horizontal shift clock CPHE1 to the rising edge of the even number line horizontal shift clock CPHE2, a period from the rising edge of the even number line horizontal shift clock CPHE2 to the rising edge of the even number line horizontal shift clock CPHE3, and a period from the rising edge of the even number line horizontal shift clock CPHE3 to the rising edge of the next odd number line horizontal shift clock CPHE1, are also a period corresponding to 1 pixel respectively.

Further, the even number line horizontal shift clock CPHE1 is shifted by 0.5 pixel (Te-To) from the odd number line horizontal shift clock CPHO1.

These odd number line horizontal shift clocks CPHO1, CPHO2, CPHO3 and the even number line horizontal shift clocks CPHE1, CPHE2, CPHE3 are input to the horizontal shift clock switching circuit 4 constituted of, for example, 9 NAND circuits.

Also, the skipped line half H inversion adding circuit 9 is constituted of an NOR circuit 6 and an exclusive OR (hereinafter simply referred to as "EX-OR") circuit 7. The NOR circuit 6 receives an input of the PAL skip signal EN shown in FIG. 4 through one of its input terminal, and an input of the half H clock signal PLL50 of a cycle of H/2 shown in FIG. 4 through the other input terminal, to thereby output a signal F1. The PAL skip signal EN outputs a low level (effective level) during the skip period.

Figure 4:
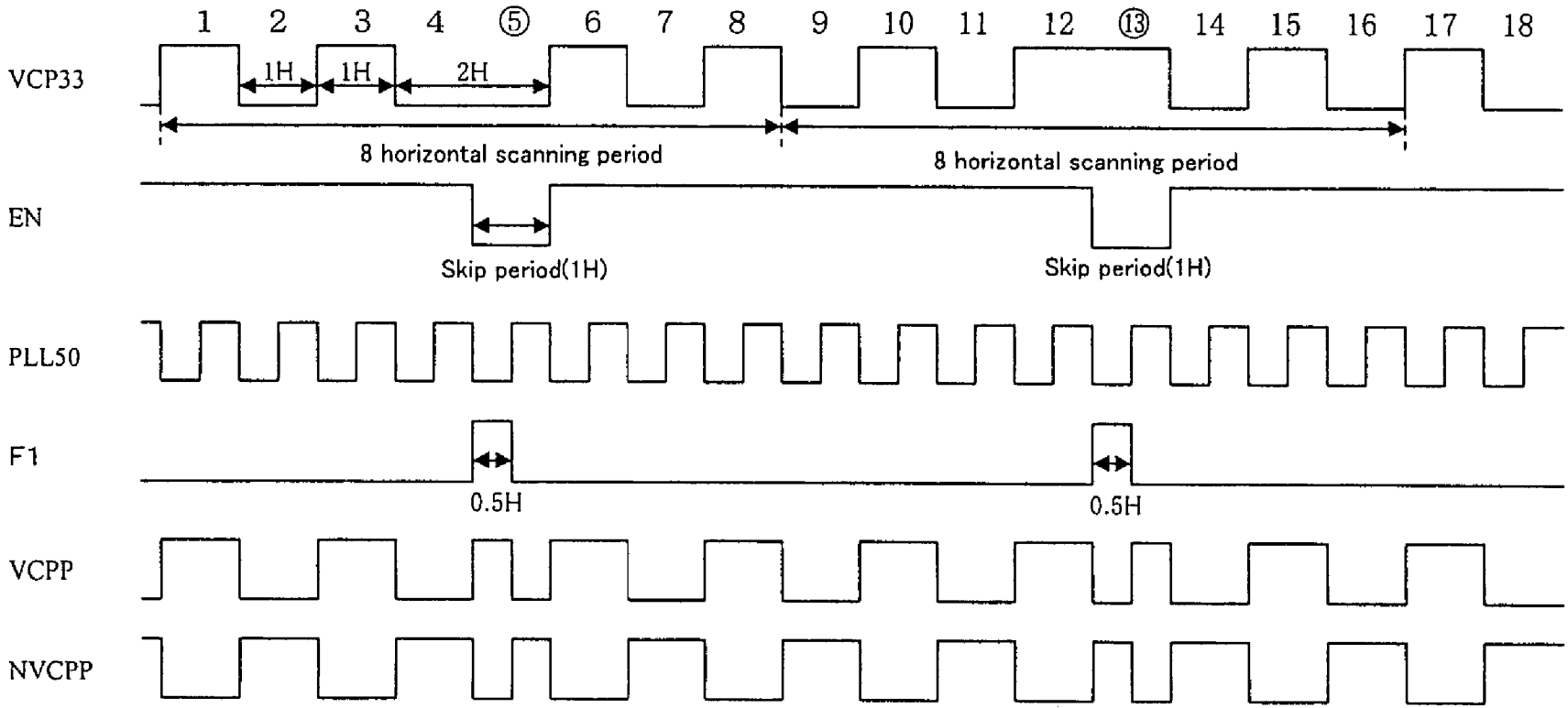
FIG. 4 shows time charts for explaining operation of the horizontal shift clock pulse selecting circuit for driving a color LCD panel shown in FIG. 1.

The EX-OR circuit 7 receives an input of the output signal F1 from the NOR circuit 6 shown in FIG. 4 through one of its input terminal, and an input of the line identifying signal VCP33 shown in FIG. 4 through the other input terminal, to thereby output a horizontal shift clock selecting signal VCPP shown in FIG. 4.

The horizontal shift clock selecting signal VCPP is input to the horizontal shift clock switching circuit 4 and to the ODD/EVEN selecting circuit 8.

Operation of the skipped line half H inversion adding circuit 9 is as follows. When the half H clock signal PLL50 is at a low level and the PAL skip signal EN is at a low level (effective level) (a period of 0.5 H), the output signal F1 from the NOR circuit 6 becomes a high level. Also, the horizontal shift clock selecting signal VCPP output from the EX-OR circuit 7 is output in the same polarity as the line identifying signal VCP33 when the output signal F1 from the NOR circuit 6 is at a low level, however the horizontal shift clock selecting signal VCPP is inverted from a state of the line identifying signal VCP33 when the output signal F1 from the NOR circuit 6 is at a high level. Also, the output signal NVCPP from the ODD/EVEN selecting circuit 8 is an inverted signal of the horizontal shift clock selecting signal VCPP, as shown in FIG. 4.

Figure 5:
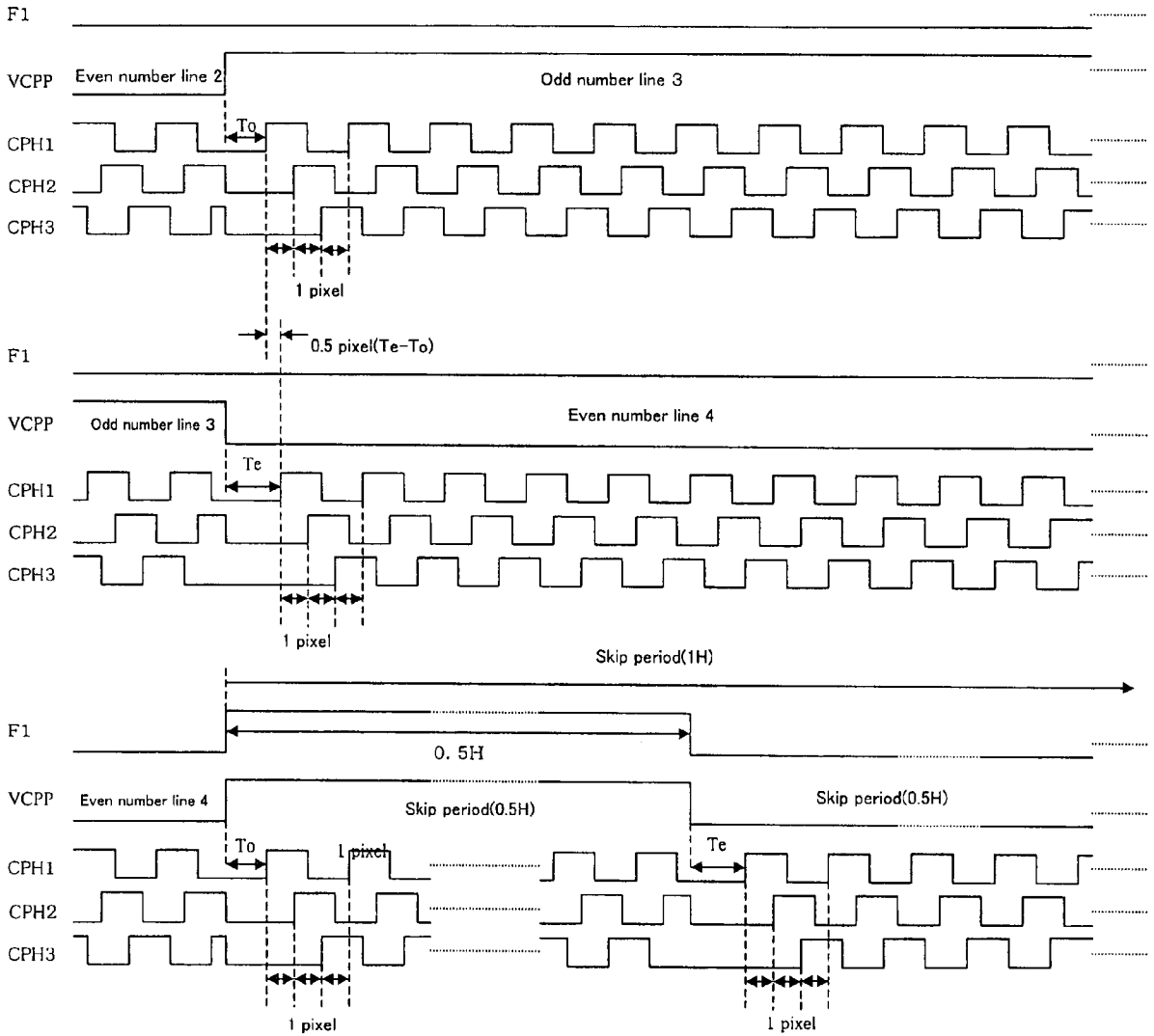
FIG. 5 shows time charts for explaining operation of the horizontal shift clock pulse selecting circuit for driving a color LCD panel shown in FIG. 1 in a PAL skip period.

As a result of inputting the horizontal shift clock selecting signal VCPP and the output signal NVCPP from the ODD/EVEN selecting circuit 8 to the horizontal shift clock switching circuit 4, the horizontal shift clock outputs CPH1, CPH2, CPH3 to be input to the color LCD panel 11 are selected as shown in FIG. 5.

In other words, when the horizontal shift clock selecting signal VCPP is at a high level (in the odd number line), the odd number line horizontal shift clocks CPHO1, CPHO2, CPHO3 are selected as the output of the horizontal shift clock switching circuit 4 and input to the color LCD panel 11, as shown in FIG. 5.

Likewise, when the horizontal shift clock selecting signal VCPP is at a low level (in the even number line), the even number line horizontal shift clocks CPHE1, CPHE2, CPHE3 are selected as the output of the horizontal shift clock switching circuit 4 and input to the color LCD panel 11, as shown in FIG. 5.

The horizontal shift clock selecting signal VCPP is normally switched in a cycle of 1 H, while the signal VCPP is switched in a cycle of H/2 in a skip period as shown in FIG. 4, therefore the horizontal shift clock outputs CPH1, CPH2, CPH3 are switched between the odd number line and the even number line in a cycle of H/2.

Referring to FIG. 5, accordingly, in case where the horizontal shift clock selecting signal VCPP is at a low level (even number line) in a line anterior to skipping, a high level of the horizontal shift clock selecting signal VCPP is output in a period of H/2 corresponding to the first half of the skip period. Therefore the odd number line horizontal shift clocks CPHO1, CPHO2, CPHO3 are selected as the horizontal shift clock outputs CPH1, CPH2, CPH3.

Likewise, a low level of the horizontal shift clock selecting signal VCPP is output in a period of H/2 corresponding to the latter half of the skip period. Therefore the even number line horizontal shift clocks CPHE1, CPHE2, CPHE3 are selected as the horizontal shift clock outputs CPH1, CPH2, CPH3.

Also, in case where the horizontal shift clock selecting signal VCPP is at a high level (odd number line) in a line anterior to skipping, a low level of the horizontal shift clock selecting signal VCPP is output in a period of H/2 corresponding to the first half of the skip period. Therefore the even number line horizontal shift clocks CPHE1, CPHE2, CPHE3 are selected as the horizontal shift clock outputs CPH1, CPH2, CPH3.

Likewise, a high level of the horizontal shift clock selecting signal VCPP is output in a period of H/2 corresponding to the latter half of the skip period. Therefore the odd number line horizontal shift clocks CPHO1, CPHO2, CPHO3 are selected as the horizontal shift clock outputs CPH1, CPH2, CPH3.

According to the foregoing operation mode, the horizontal shift clock outputs CPH1, CPH2, CPH3 are always switched from the odd number line horizontal shift clocks CPHO1, CPHO2, CPHO3 to the even number line horizontal shift clocks CPHE1, CPHE2, CPHE3, or from the even number line horizontal shift clocks CPHE1, CPHE2, CPHE3 to the odd number line horizontal shift clocks CPHO1, CPHO2, CPHO3 when switching the line, even in a PAL skip period. As a result, the digital switching noise caused by the horizontal shift clock outputs CPH1, CPH2, CPH3 can be leveled off, and an influence to an oscillation frequency of the voltage controlled oscillator 1 can be minimized.

Therefore, a timing of the horizontal shift clock outputs CPH1, CPH2, CPH3 is no longer shifted from a desired timing. Consequently, when an image is displayed in the color LCD panel of a delta alignment, such phenomena does not take place that the image is shifted in a line next to the skipped line, and that a straight line is not displayed in a straight form despite that a signal to display a straight line is input to the color LCD panel.

Further, in the foregoing embodiment of the present invention a case in which a horizontal scanning period is skipped every 8th horizontal scanning period has been described, however the ratio can be arbitrarily determined in a form of skipping m horizontal scanning periods out of n horizontal scanning periods (m, n are arbitrary integers, and m<n). For example, in case of skipping 2 horizontal scanning periods every 14th horizontal scanning period, programming such that the skip signal EN is output at a low level twice per 14 horizontal scanning periods enables switching the horizontal shift clock at every line (position to skip can be arranged as desired).

Also, in addition to the color LCD panel employed in the embodiment of the present invention, a color LCD panel of a simultaneous sampling type of the three pixels of RGB having horizontal shift clocks shifted by 1.5 pixels at every line is also available. In such a case also, it is possible to level off the digital switching noise caused by the horizontal shift clock, by adopting the line-based switching of the horizontal shift clock in the PAL skip period, as the embodiment described above. As a result, an influence to an oscillation frequency of the voltage controlled oscillator can be minimized.

Further, in the foregoing embodiment the selecting state of the horizontal shift clock is inverted once in half a cycle of a horizontal scanning period (H/2) in a PAL skip period based on the PAL skip signal EN and the half H clock signal PLL50 of half a cycle of a horizontal scanning period.

However, the inverting cycle of the horizontal shift clock in a PAL skip period may also by one 2Nth of a horizontal scanning period (H/2N) (N is a positive integer) without limitation to H/2. The clock signal in such mode becomes an H/2N clock signal. In this case, inversion of the horizontal shift clock is performed an odd number of times. What is important is, in short, that a number of times (period of time) of the high level and the low level of the horizontal shift clock selecting signal VCPP become equal in a skip period, in other words the selecting times of the odd number line horizontal shift clock and the even number line horizontal shift clock becomes the same. It is important that a number of selecting times (period of time) of the odd number line horizontal shift clock and the even number line horizontal shift clock becomes equal in a PAL skip period.

Furthermore, in the foregoing embodiment the selecting state of the horizontal shift clock by the horizontal shift clock switching circuit 4 is inverted immediately after the start of a PAL skip period from a selecting state in a normal period right before the start of a skip period based on the PAL skip signal EN and the half H clock signal PLL50.

However, it is not imperative to invert the selecting state of the horizontal shift clock by the horizontal shift clock switching circuit 4 immediately after the start of a PAL skip period from a selecting state in a normal period right before the start of a skip period. As described above, what is important is that a number of times (period of time) of the high level and the low level of the horizontal shift clock selecting signal VCPP become equal in a skip period, in other words the selecting times of the odd number line horizontal shift clock and the even number line horizontal shift clock becomes the same. It is important that a number of selecting times (period of time) of the odd number line horizontal shift clock and the even number line horizontal shift clock becomes equal in a PAL skip period.

What is claimed is:

1. A horizontal shift clock pulse selecting circuit for driving a color LCD panel, comprising:

a voltage controlled oscillator;

an odd number line horizontal shift clock generator for generating an odd number line horizontal shift clock to select a pixel in an odd number line of the color LCD panel based on an output signal of said voltage controlled oscillator;

an even number line horizontal shift clock generator for generating an even number line horizontal shift clock to select a pixel in an even number line of the color LCD panel based on an output signal of said voltage controlled oscillator;

a horizontal shift clock switching device for selectively outputting said odd number line horizontal shift clock and said even number line horizontal shift clock to the color LCD panel; and a shift clock switch controller for providing a shift clock switching signal to said horizontal shift clock switching device, wherein:

said shift clock switch controller receives controlling inputs including a PAL skip signal for skipping a horizontal scanning period at a ratio of m horizontal scanning periods per n horizontal scanning periods, wherein m and n are both arbitrary integers that satisfy the condition m<n, an H/2N pulse to be inverted in a cycle of one 2Nth of a horizontal scanning period H, wherein N is a positive integer, and a line selecting pulse for selecting either an odd number line or an even number line, said shift clock switch controller causes said horizontal shift clock switching device to select either an odd number line shift clock or an even number line shift clock according to said line selecting pulse in a normal period where said PAL skip signal is not at an effective level, and said shift clock switch controller inverts a selecting state of said horizontal shift clock by said horizontal shift clock switching device in a cycle of one 2Nth of a horizontal scanning period H in response to said H/2N pulse in a PAL skip period where said PAL skip signal is at an effective level.

2. The horizontal shift clock pulse selecting circuit for driving a color LCD panel as recited in claim 1, wherein said shift clock switch controller inverts immediately upon start of a PAL skip period the selecting state of said horizontal shift clock by said horizontal shift clock switching device from a selecting state right before the start of the skip period.

3. The horizontal shift clock pulse selecting circuit for driving a color LCD panel as recited in claim 1, wherein said color LCD panel is provided with delta-aligned pixels of the three primary colors of RGB.

4. The horizontal shift clock pulse selecting circuit for driving a color LCD panel as recited in claim 2, wherein said color LCD panel is provided with delta-aligned pixels of the three primary colors of RGB.

* * * * *